United States Patent [19]

Guritz et al.

[11] 4,342,072

[45] Jul. 27, 1982

[54] LIGHTING FIXTURE

[76] Inventors: Kenneth E. Guritz, 570 Emerald Harbor Dr., Longboat Key, Fla. 33548; Michael L. Guritz, 6904 Manatee Ave., W., Bradenton, Fla. 33508

[21] Appl. No.: 156,674

[22] Filed: Jun. 5, 1980

[51] Int. Cl.[3] ..... F21V 19/04

[52] U.S. Cl. ... 362/222; 362/225;238;251;297;306;365

[58] Field of Search ..... 362/219, 220, 221, 222, 362/232, 238, 239, 260, 285, 296, 297, 306, 308, 310, 319, 329, 364, 365, 366, 217, 251

[56] References Cited

U.S. PATENT DOCUMENTS

| | | | |
|---|---|---|---|
| 2,413,666 | 12/1946 | Tuck et al. | 362/220 |
| 2,516,660 | 7/1950 | Versen | 362/364 |
| 2,620,580 | 12/1952 | Dwinell | 362/260 |
| 2,831,962 | 4/1958 | Winkler et al. | 362/219 |
| 3,019,332 | 1/1962 | Schiffer | 362/219 |
| 3,117,728 | 1/1964 | Waldbauer | 362/219 |
| 3,120,929 | 2/1964 | Henning | 362/219 |
| 3,154,001 | 10/1964 | Zurawski | 362/260 |
| 3,297,075 | 1/1967 | Howell et al. | 362/219 X |
| 3,299,264 | 1/1967 | Lipscomb | 362/219 |
| 4,129,900 | 12/1978 | Sanz | 362/217 |
| 4,175,281 | 11/1979 | Lonseth | 362/365 |
| 4,208,702 | 6/1980 | Wotowiec | 362/260 |

FOREIGN PATENT DOCUMENTS

| | | | |
|---|---|---|---|
| 1533443 | 6/1968 | France | 362/220 |

*Primary Examiner*—Peter A. Nelson

*Attorney, Agent, or Firm*—Arthur W. Fisher, III

[57] ABSTRACT

A lighting fixture comprising a housing having a pair of supporting members disposed longitudinally along the inner portion of the side walls of the housing to slidingly engage a circuitry and light carrying tray thereon.

4 Claims, 2 Drawing Figures

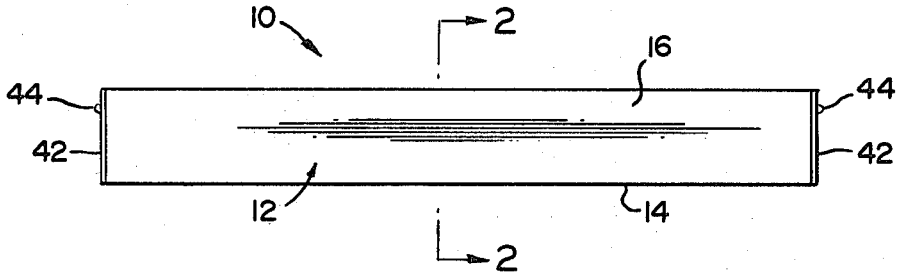
FIG. 1
FIG. 2
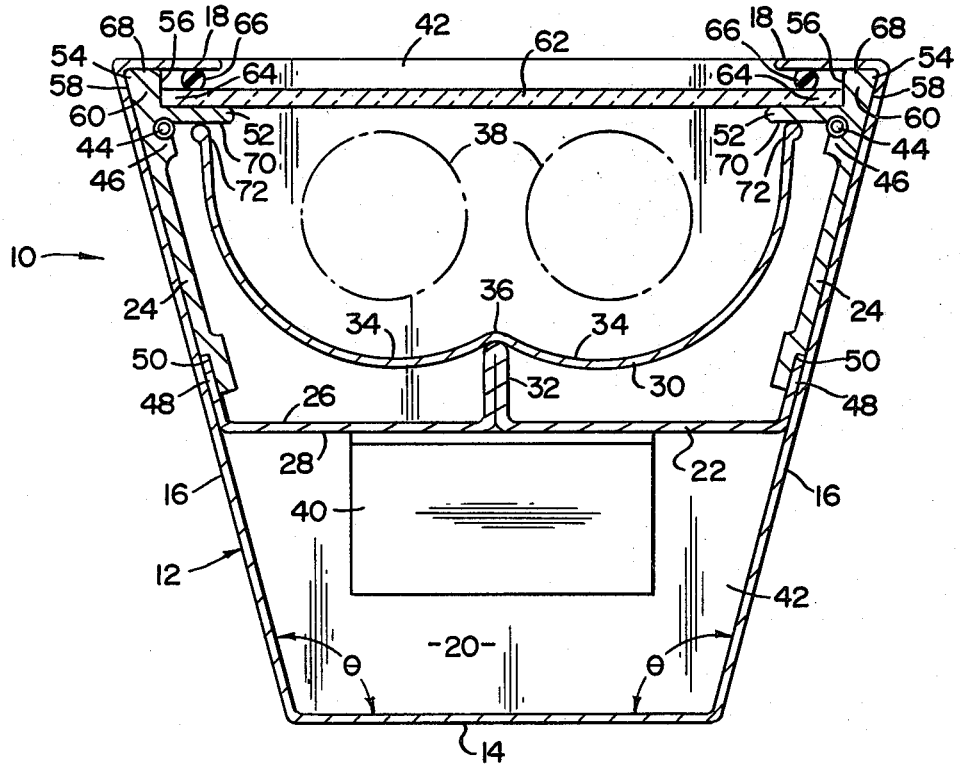

LIGHTING FIXTURE

BACKGROUND OF THE INVENTION

1. Field of the Invention

A lighting fixture having a circuitry and light carrying tray slidingly mounted within a housing to facilitate maintenance and repair thereof.

2. Description of the Prior Art

A vast number of industrial and commercial lighting fixtures have been designed. Unfortunately many of these designs inhibit efficient maintenance and lack sufficient moisture proofing.

Thus, a need exists for a reliable, moisture proof, easily maintained lighting fixture.

SUMMARY OF THE INVENTION

The present invention relates to a lighting fixture comprising a housing defined by base plate and by side walls projecting upwardly and outwardly from the opposing edges of the base plate, fixedly secured. The uppermost free end of each side wall is bent reversely toward one another to lie co-planar with one another on a plane parallel to the plane of the base plate in fixed spaced relation therefrom.

Slidingly received within the housing are the circuitry and light carrying tray and the glass supporting extrusion members.

A reflective shield is carried by the upper surface of the tray.

The electric circuitry for the lights is mounted to and suspended from the lower surface of the slidable tray. It will thus be seen that routine maintenance procedures such as changing a light fixture or ballast transformer involves no substantial disassembly of the invention in contra distinction to earlier light assemblies.

The only disassembly procedure of the light required to be followed as a condition precedent to the sliding extraction of tray from the cavity is that of removing one of the end plates.

A rectangular plate of glass or other transparent or at least transluscent material is supportingly engaged adjacent its opposing longitudinal edges by the shield means.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a side view of the lighting fixture.

FIG. 2 is a cross-sectional end view of the lighting fixture taken along line 2—2 of FIG. 1.

Similar reference characters refer to similar parts throughout the several views of the drawings.

DETAILED DESCRIPTION OF THE PREFERRED EMBODIMENT

Referring now to FIG. 2, it will be seen that the inventive lighting fixture 10 comprises a housing 12 defined at least in part by an elongated, generally rectangular planar base plate 14, and by side walls 16 fixedly secured thereto or interiorly formed therewith, the side walls 16 projecting upwardly and outwardly, i.e., in a mutually diverging relation to one another, from the opposing, substantially parallel, longitudinal edges of the base plate 14. The oblique angle $\theta$ between the plane of the base plate 14 and each of the side walls 16 is substantially the same. The uppermost free end 18 of each side wall 16 is bent reversely toward one another to lie co-planar with one another on a plane parallel to the plane of the base plate 14 in fixed spaced relation therefrom. Each of such reversely bent free ends 18 is thus seen to define an inwardly directed flange means extending the length of the housing 12.

It will be appreciated that the base plate 14 and side walls 16 collectively define an elongated channel-shaped cavity 20. Slidingly received within this cavity 20 are the remaining major elements of this invention, the circuitry and light carrying tray 22 and the glass supporting extrusion members 24. It should be noted at the outset that servicing of the inventive light 10 involves the axial sliding of tray 22 relative to the longitudinal axis of the housing 12. Although the extrusion members 24 are each adapted for slide fit engagement with separate ones of the side walls 16, such extrusion members 24 would not be displaced during such servicing.

The tray 22 has an upper surface 26 and a lower surface 28. A reflective shield 30 is carried by the upper surface 26 of the tray 22 by means of an elongated spacing member 32. It will be noted that the reflective shield 30 may include two concave portions 34 defined on opposite sides of a fold or center line 36 that extends the length of the shield 30 and is disposed substantially mid-width thereof. Such twin reflective surfaces 34 provide reflective surfaces individual to each (preferably florescent) light 38. Earlier reflective shields, lacking twin surfaces individual to each flight, result in the testing of a dark shadow (not shown), that substantially coincides in position with the folding line 36 of this invention. Elimination of the dark shadow obviously results in a more efficient lighting of the area sought to be lit.

The electrical circuitry, generally designated 40 for the lights 38 is mounted to and suspended from the lower surface 28 of the slidable tray 22. It will thus be seen that routine maintenance procedures such as changing a light fixture or ballast transformer involves no substantial diassembly of the invention 10, in contra distinction to earlier light assemblies. The tray 22 need only be slidingly pulled from the cavity 20 to the extent necessary. Such tray 22 need never be pulled from the cavity 20.

The only disassembly procedure of the light 10 required to be followed as a condition precedent to the sliding extraction of tray 22 from the cavity 20 is that of removing one of the end plates 42. Each end plate 42 is complementally formed relative to the housing 10 in end elevational view or in transverse cross sectional view. A pair of fastening means, preferably screws 44 retain each of the longitudinally spaced, opposed end plates 42 only one of which is shown. Each screw 44, is in screw-threaded engagement with separate complementally threaded portions 46 of the extrusion members 24.

It should be noted that each side wall 48, of the tray 22 is slidingly received within an associated indent 50 provided as a part of each extrusion member 24.

A close look at the novel extrusion members 24 reveals that the portions 46 that receive the screw means 44 therein only partially surround each screw thereby facilitating the extrusion process. Further, each screw-receiving portion 46 is formed integrally with, at the bottom of and inwardly projection shelf means 52 that lies in a plane parallel to the plane of the base plate 14 and the inwardly directed flanges 18 of the housing 12. Each shelf means 52 further includes a back wall 54 that has its inwardly facing face 56 disposed othogonally to the plane of the base plate 12. Its outwardly facing face 58 abuts side wall 16 of housing 12 so that a wedge-shaped in section portion 60 is defined therebetween.

A rectangular plate of glass or other transparent or at least transluscent material 62 is supportingly engaged adjacent its opposing longitudinal edges 64, by the shelf means 52. Upstanding back wall surfaces 56 abut the longitudinal edges 64.

An O-ring 66 operates as a sealing gasket to bar entry of moisture into the cavity 20. The ring 66 is disposed continuously about the periphery of the glass means 62 adjacent its transverse and longitudinal boundries on the upper surface thereof. The O-ring 66, accordingly is held in sandwiched relation between the lower surface of the inwardly directed flanges 18 and the upper surface of the glass means 62. It will now be appreciated that the spatial distance between the inwardly directed flanges 18 and the shelf means 52 is critical. The neck portion 68 of each extrusion member 24 is therefore specifically structured to dispose the flanges 18 and the shelves 52 so that a tight fit is achieved therebetween to thereby ensure the effectiveness of the sealing O-ring 66. It will also be noted that the bottom side of each shelf 52, inwardly of the screw receiving portions 46 as at 70 defines abutting surfaces for the opposed parallel, outermost free ends 72 of the reflective shield means 30. Since the indent portion 50 of each extrusion member 24 is configured and dimensioned to receive the opposed, parallel outermost free ends of the side walls 48 of the tray 22 as disclosed herein above, it is clear that the entire structural configuration of the extrusion members 24 makes possible many of the desirable features of this invention.

It will thus be seen that the objects set forth above, and those made apparent from the preceding description, are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A lighting fixture comprising a housing including a substantially planar housing base plate having side walls extending upwardly from said substantially planar housing base plate and terminating in a pair of inwardly projecting uppermost ends to cooperatively form an elongated cavity, a pair of supporting members disposed on the upper portion of said upperwardly projecting side walls each comprising a detent formed on the lower portion therefrom and a shelf extending inwardly formed on the upper portion thereof in spaced relation relative to said respective inwardly projecting uppermost ends, a substantially transparent material operatively supported on said oppositely disposed shelves, said supporting members further include an open channel threaded portion formed below said oppositely disposed shelves to partially receive a fastening member to affix a pair of end plates to opposite ends of said housing, and a tray having a substantially planar tray base plate and upwardly projecting side walls to cooperatively press fit slidingly within said detents, circuitry disposed on the lower surface of said substantially planar tray base plate and reflective shield and light source supported on the upper surface of said substantially planar tray base plate, the uppermost portions on opposite sides of said reflection shield disposed to engage said oppositely disposed shelves to press fit said reflective means between said tray and said oppositely disposed shelves.

2. The light fixture of claim 1 wherein said upperwardly projecting side walls of said housing diverge mutually outwardly relative to one another from opposing substantially parallel longitudinal edges of said base plate.

3. The lighting fixture of claim 1 wherein said reflective shield comprises a pair of concave portions defined on opposite sides of center line of said reflective shield extending substantially the length thereof.

4. The lighting fixture of claim 1 wherein an O-ring is pressed fitted between the upper surface of said transparent material and the lower surface of said inwardly projecting pair of said uppermost ends.

* * * * *